US007069873B2

(12) United States Patent
Seidel

(10) Patent No.: US 7,069,873 B2
(45) Date of Patent: Jul. 4, 2006

(54) WATERCRAFT WITH INFLATABLE STABILIZATION RING

(76) Inventor: Rainer Seidel, Marienstr. 12/17, Hamm (DE) 59067

( * ) Notice: Subject to any disclaimer, the term of this patent is extended or adjusted under 35 U.S.C. 154(b) by 0 days.

(21) Appl. No.: 10/492,324

(22) PCT Filed: Oct. 12, 2001

(86) PCT No.: PCT/DE01/03924

§ 371 (c)(1),
(2), (4) Date: Jun. 29, 2004

(87) PCT Pub. No.: WO03/035462

PCT Pub. Date: May 1, 2003

(65) Prior Publication Data

US 2004/0261685 A1 Dec. 30, 2004

(51) Int. Cl.
*B63B 43/12* (2006.01)

(52) U.S. Cl. ..... 114/360

(58) Field of Classification Search ..... 114/360, 114/68, 69

See application file for complete search history.

(56) References Cited

U.S. PATENT DOCUMENTS 4,660,497 A * 4/1987 Cochran ..... 114/345
4,996,936 A * 3/1991 Brundritt ..... 114/68
6,814,019 B1 * 11/2004 Mears et al. ..... 114/68
6,830,004 B1 * 12/2004 Mears et al. ..... 114/68
6,845,726 B1 * 1/2005 Mears et al. ..... 114/68

FOREIGN PATENT DOCUMENTS

| | | | |
|---|---|---|---|
| DE | 38 10 546 A1 | * | 10/1988 |
| DE | 297 19 883 U1 | * | 4/1998 |
| DE | 298 02 911 U1 | * | 8/1998 |
| DE | 197 47 359 A1 | * | 5/1999 |
| EP | 0258008 | * | 3/1988 |
| GB | 2 354 487 | * | 3/2001 |

* cited by examiner

*Primary Examiner*—Sherman Basinger
(74) *Attorney, Agent, or Firm*—Cohen, Pontani, Lieberman & Pavane

(57) ABSTRACT

Watercraft with a solid hull and a solid outer side, where a recess extending essentially in a horizontal plane is formed in the outer side of said watercraft above the water line, in which recess an elastically deformable safety element is permanently installed, which element is folded onto itself in a first operating state and is inflated by means of a pressurized fluid from a source of pressurized fluid in a second operating state, characterized in that at least one undercut projection is formed in the recess in the outer side of the watercraft, and in that the safety element has at least one concavity designed as the negative of the positive shape of the projection, so that the projection engages positively and nonpositively with the concavity.

9 Claims, 3 Drawing Sheets

WATERCRAFT WITH INFLATABLE STABILIZATION RING

PRIORITY CLAIM

This is a U.S. national stage of application No. PCT/DE01/03924, filed on 12 Oct. 2001. Priority is claimed on that application.

BACKGROUND OF THE INVENTION

1. Filed of the Invention

The present invention pertains to a watercraft with a solid hull and a solid outer side, where a recess extending essentially in a horizontal plane is formed in the outer side of the watercraft above the waterline, in which recess an elastically deformable safety element is permanently installed, which is folded onto itself in a first operating state and is inflated by means of a compressed gas from a source of pressurized fluid in a second operating state.

2. Description of Prior Art

A watercraft of this type is known from, for example, DE 197 47 359. The elastically deformable safety element is screwed over its entire length to the outer side of the watercraft by threaded stay bolts. The strength of this screwed, nonpositive connection must be nearly equal over the entire length of the element. This is a complicated piece of work and difficult to verify. It is possible, for example, for some of the threaded stay bolts to break during installation without anyone noticing. Even in the case that the damage should be noticed during the final inspection, correcting the problem is relatively complicated. The most significant disadvantage, however, is that the safety element cannot be installed without a considerable amount of effort.

SUMMARY OF THE INVENTION

It is therefore the task of the invention to create a watercraft of the general type indicated above with a safety element which can be installed and uninstalled easily.

The task is accomplished in that at least one undercut projection is formed in the recess in the outer side of the watercraft, and in that the safety element has at least one concavity, the shape of which is designed to be the negative of the positive shape of the projection, such that the projection engages both positively and nonpositively with the concavity.

The inventive solution provides a simple and effective design, which makes it possible to create a safety system which can be installed in watercraft without any additional components requiring manipulation.

The elastic safety element, with its projections, can be pulled in the longitudinal direction either from the bow or from the stern onto the projections, which are undercut in complementary fashion.

It is also advantageous for the adjacent projections of the recess to define a space therebetween in the approximate shape of T. As a result, the safety element will be held more securely on the hull.

The arrangement of the projections according to the present invention also lead to an advantageous fixation of the safety element on the hull.

Additional advantages are:

predictable security against sinking;

predictable security against capsizing;

predictable security in the event of underwater collisions (reefs, icebergs);

a system of extreme sturdiness and durability;

a design which provides the hull with additional stabilization;

a system which is relatively simple and uncomplicated; reuseable;

the possibility of either manual or automatic actuation;

low cost because of the elimination of the conventional rescue and safety devices;

more favorable all-inclusive insurance coverage;

a system which saves both the crew and the valuable ship;

a system which can be produced in standard sizes; and a system which is suitable for any type of boat.

BRIEF DESCRIPTION OF THE DRAWINGS

Embodiments of the present invention are described in greater detail below on the basis of the drawing.

DETAILED DESCRIPTION OF THE PREFERRED EMBODIMENTS

Figure 1A:
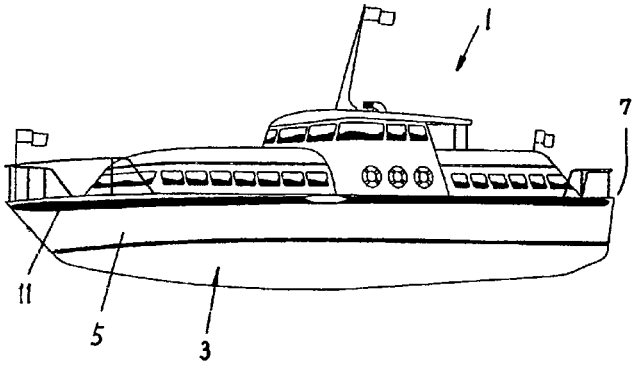
FIGS. 1*a* and 1*b* show schematic side and front views, respectively, of a watercraft with a solid hull and a solid outer side with an elastically inflatable safety element according to the invention in a first, unactivated state.
Figure 1B:
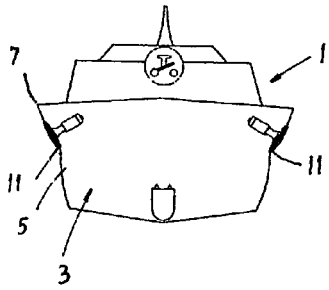

FIGS. 1*a* and 1*b* show schematic cross sections of a watercraft 1 with a solid hull 3 and a solid outer side 5. The outer side of the watercraft is above the waterline and is provided with a recess 9 (see FIG. 3) relatively close to its upper edge 7. For reasons of stability, the contour of the recess 9 can also be reproduced on the inner side of the watercraft, so that the thickness of the side overall is maintained in the area of recess 9. The term "solid outer side of the watercraft" means here that at least the part of the outer side in which the recess is to be formed is relatively resistant to the pressures acting from the outside. An outer side made of a material which is flexible in and of itself but which, as a result of stiffening or other chemical and/or physical measures applied at least in the area of the recess, has the appropriate strength, can also be described as "solid" in the sense being used here.

An elastically deformable safety element 11 is installed in a first operating state in the recess 9. In this first operating state, the elastically deformable safety element 11 extends over only a small part of the vertical plane of the outer side of the watercraft, just enough to ensure that the elastically deformable safety element 11 can serve, for example, as a bumper strip or sheer rail. The elastically deformable safety element 11 is preferably a hose-like body, which is folded onto itself in its first operating state so that it thus acquires the 3-dimensional shape which it must have to fulfill its secondary function as a bumper strip. The elastically deformable safety element 11, i.e., the hose-shaped body, is attached permanently in the recess 9 so that it cannot slip out of position.

In the interior of the hull 3, there is a source of pressurized fluid (not shown), which is effectively connected via a conventional system of conduits (not shown) to the elastically deformable safety element 11. The source of pressurized fluid can be any suitable device which can dispense a fluid under pressure in the conventional manner, such as a compressed air system. The term "pressurized fluid" was chosen in order to include sprayable foams, liquids, and gases other than air, etc., which either remain in their original aggregate state under the pressures being applied to them or which change their state as a function of those pressures.

Figure 2A:
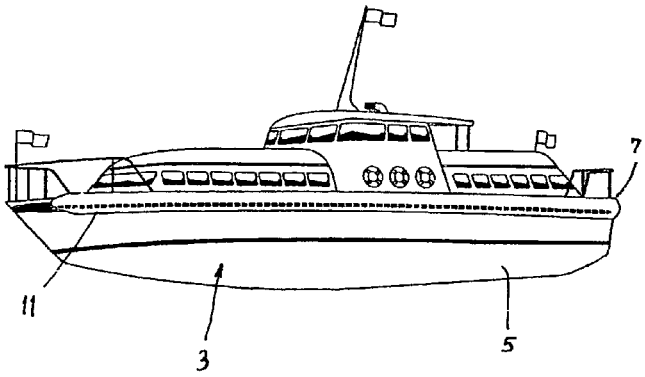
FIGS. 2*a* and 2*b* show schematic side and front views, respectively, of a watercraft with a solid hull and a solid outer side with the elastically deformable safety element of FIGS. 1*a*/1*b* in a second, activated operating state.
Figure 2B:
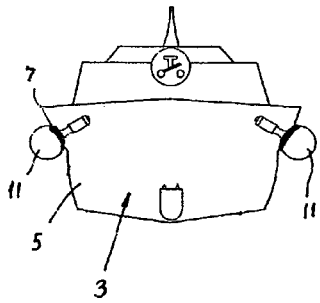

FIGS. 2*a* and 2*b* show the elastically deformable safety element 11 in a second operating state. In this state, the pressurized fluid source has been activated, so that the selected fluid has been blown through the conduit system into the elastically deformable safety element 11, shown folded onto itself in FIGS. 1*a* and 1*b*. As a result, the elastically deformable safety element 11 is completely filled with the fluid (which now is present in the safety element 11 either in its original aggregate state such as compressed air or in a new aggregate state such as foam) and now rests flush against the surface of the recess 9. The buoyancy thus obtained at the upper edge of the outer side 5 of the watercraft stabilizes the position of said watercraft 1, after it has experienced an emergency at sea. When an emergency occurs at sea, the pressurized fluid system can be activated manually, or it can be triggered automatically by means of suitable sensors (not shown). Sensors, which detect when a watercraft or other type of craft has become unstable and then trigger the corresponding safety systems are generally known and are therefore not described here in any further detail.

In the present embodiment, the recess 9 has an essentially conical shape with a curvature which increases slightly toward the apex; this curvature helps to keep the safety element 11 in the proper position when it is in its second operating state.

The pressurized fluid-filled life ring extending around the outer side 5 of the watercraft is able to keep said watercraft 1 which has encountered an emergency at sea in a relatively stable position. The watercraft can remain in this position until the problem is solved, that is, either until it is rescued or until it can reach a safe harbor, etc.

Figure 3:
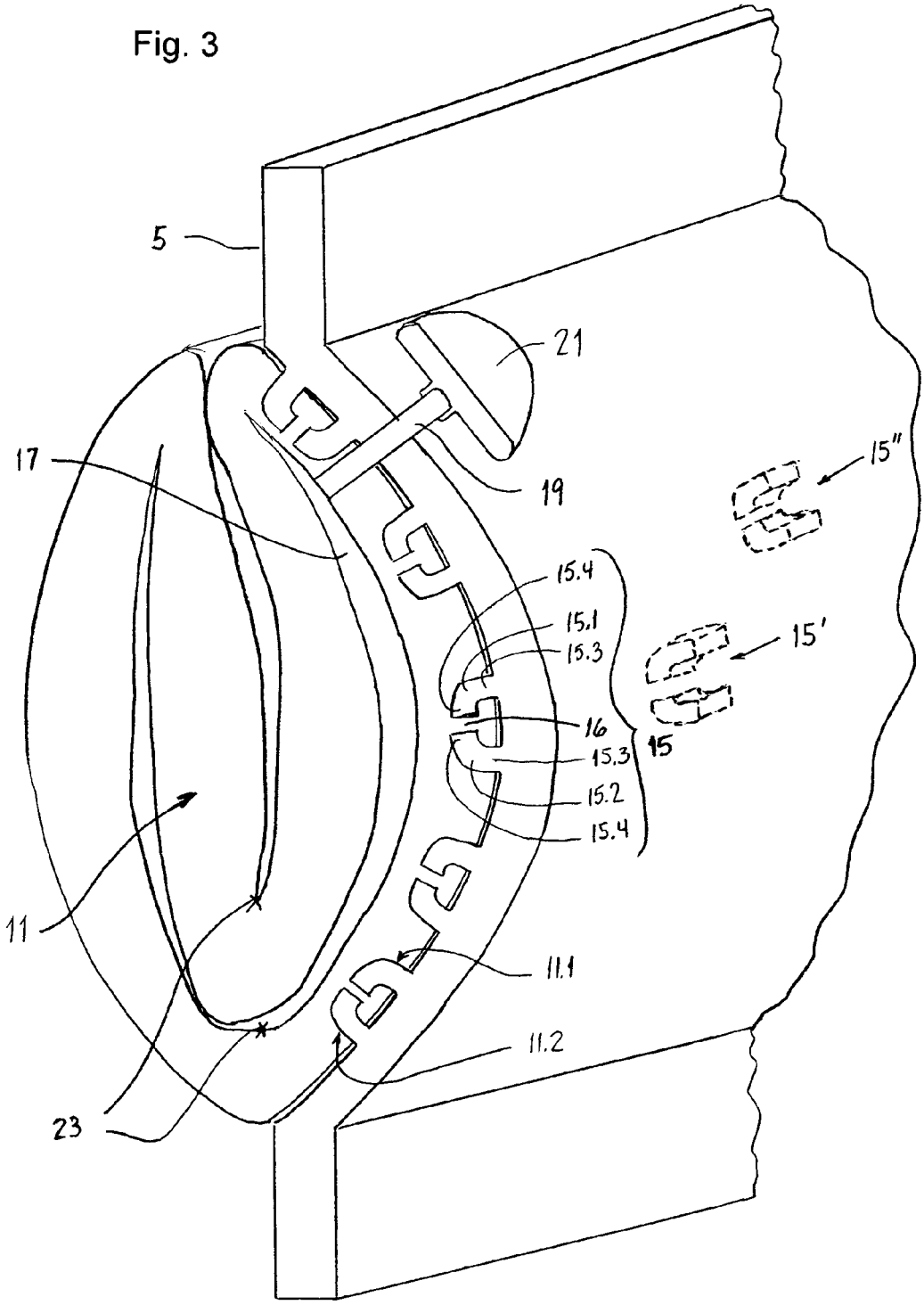
FIG. 3 shows a schematic perspective cross section through an elastically deformable safety element in the first operating state according to the present invention.

FIG. 3 shows in detail the elastically deformable safety element 11 in its first, uninflated operating state. The recess 9 can be seen in the outer side 5 of the watercraft. In the area of the recess 9, a series of projections 15 are formed on the outer side 5 of the watercraft. These projections 15 are either an integral part of the outer side 5 of the watercraft in the area of the recess 9 or represent separate components, which are attached afterwards to the outer side 5. Any means known according to the state of the art can be used to attach them, including screws, rivets, and adhesives.

Even though several projections 15 are shown in the present embodiment, any desired number of projections 15 can be selected, including only a single projection, depending on the size of the watercraft 1, i.e., on the dimensions of the recess 9.

Each projection 15 has two sidepieces 15.1 and 15.2, the connected ends 15.3 of which are permanently attached to the outer side 5 of the watercraft. The other, free ends 15.4 are bent or curved in such a way that they remain a certain distance apart. Each projection 15, with its two sidepieces 15.1 and 15.2, therefore forms the boundaries of an undercut groove with, for example, the approximate shape of a "T". In the present embodiment, the sidepieces 15.1, 15.2 are in the form of circular arcs of variable radius. The length of the individual sidepieces 15.1, 15.2 can also be different, depending on where a projection 15 is situated in the recess, which also has a curved shape. The distance between the free ends 15.4 of each projection 15 is preferably the same for all the projections 15, thus forming the gaps 16. These gaps 16 are limited by the nearly parallel free ends 15.4 of the sidepieces 15.1, 15.2. The parallel free ends 15.4 of a certain projection 15 are preferably not parallel, however, to the parallel free ends 15.4 of the projection 15 adjacent to it in the vertical plane. Instead, the free ends 15.4 of projections 15 adjacent to each other in a vertical plane converge.

When several projections 15 are present, they can be distributed over the surface of the recess in any suitable way. The projections can, for example, be arranged at equal distances from each other in the vertical and/or horizontal direction. The projections 15 can also be offset from each other horizontally and vertically. For example, projections 15' and 15" in FIG. 3 (shown in dotted lines as being behind the recess 9 in the outer side 5 of the watercraft) are offset vertically and horizontally from each other. Furthermore, projection 15' is in the same horizontal row as the central projection 15.

In the present embodiment, a circumferential section of the safety element 11 designed as a hose-like body is provided with concavities 11.1 and 11.2. These concavities 11.1 and 11.2 are designed to conform to the sidepieces 15.1 and 15.2 of the projections 15 and are thus preferably designed as negatives to the positive shapes of the projections. The folded-together safety element 11 encloses a cavity 17, which, in this operating state, has a visible volume only for the sake of illustration. The cavity 17 is connected by a conduit 19, a valve, etc., to the pressurized fluid source 21. During installation, the elastic safety element 11 is pulled either from the bow or from the stern so that its concavities 11.1 and 11.2 fit over the sidepieces 15.1 and 15.2 of the projections 15 and is thus held firmly in the recess 9. Because the retaining action acting on the hose-like body extends over a large area, the hose-like body is not subjected to excessive loads at individual points, which could cause it to tear.

It is also possible to provide partitions (not shown) in the safety element 11; these partitions could also be made semipermeable. A multi-chamber arrangement such as this ensures that the entire safety system will not be destroyed in the event of a collision and the ensuing damage to individual areas of the elastically deformable safety element 11. Instead, the safety element will be able to continue to function more-or-less as intended.

It can be seen from the figures that the elastically deformable safety element 11 is arranged essentially in a horizontal plane. Other orientations would also be conceivable, however, depending on the type of ship.

In another embodiment, which is not described in detail here, it would also be conceivable that the elastically deformable safety element 11 could be designed not as a hose but rather only as a section of a hose wall, the free longitudinal edges of which are attached to the outer side 5 of the watercraft. In this case, the pressurized gas would be blown into a hollow body which would consist in part of the recess 9 in the outer side 5 of the watercraft and in part of the inside wall of the section of hose. Undercut grooves (not shown) could be provided for the attachment to the outer side 5 of the watercraft. For example, T-shaped grooves, into which a correspondingly formed edge of the hose body is introduced, could be provided. Here, too, the materials can be stiffened by metal cores or other solid materials, so that a secure connection will always be guaranteed.

Several calculations of the buoyancies of the inventive elastically deformable safety element are given below. The data are approximations with a tolerance no more than 1.5%. The intrinsic weight of the device was taken into account:

| Diameter | Buoyancy per Meter | for Watercraft |
|---|---|---|
| 30 cm | 70 kg | to 2.5 T |
| 50 cm | 196 kg | to 7 T |
| 70 cm | 385 kg | to 27 T |
| 90 cm | 635 kg | to 75 T |

In the case that the elastically deformable safety elements 11 serve to prevent capsizing, the lifting forces act as the strongest possible lever on the vertical center-of-gravity line of the watercraft.

In the event that the elastically deformable safety elements 11 serve as floats to prevent the watercraft from sinking, only about one-third of the weight of the parts in the water (plus the parts located above the waterline) must be counterbalanced. Because of the height at which the elements are attached, i.e., near the upper edge of the side of the watercraft, a safety buoyancy of approximately 25% of the entire weight of the watercraft can be taken into account.

The safety system described here can also be installed on existing watercraft. It is conceivable that the elastically deformable safety element 11 could be attached afterwards to the breastwork area (uppermost area of the hull 3) and possibly designed to conform to the shape of the outer side of the watercraft.

Figure 4A:
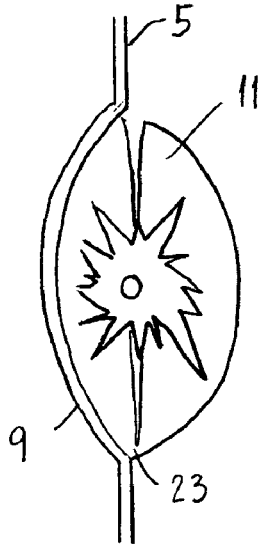
FIGS. 4*a*, 4*b*, 4*c*, and 4*d* each show a schematically illustrated phase of the activation of the safety element between the first operating state (FIG. 4*a*) and the second operating state (FIG. 4*d*).
Figure 4B:
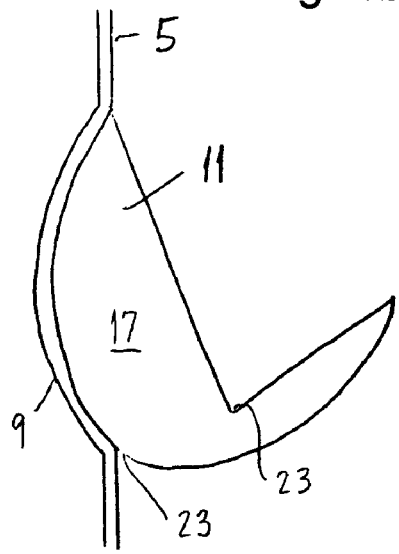
Figure 4C:
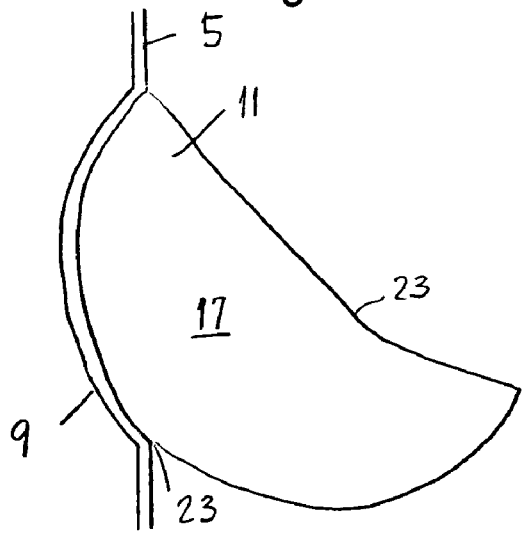
Figure 4D:
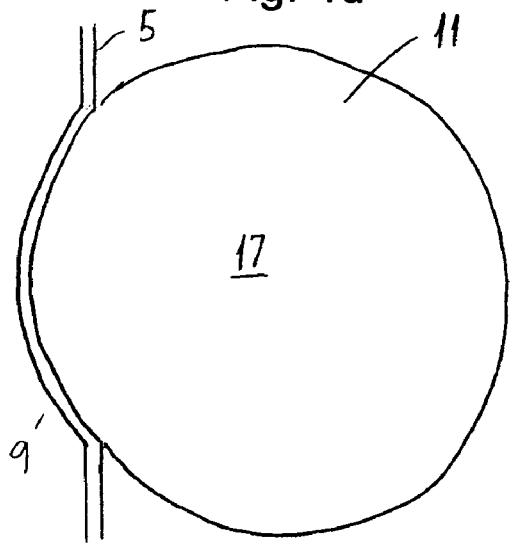

FIGS. 4*a*, 4*b*, 4*c*, and 4*d* show schematic diagrams of the first, uninflated operating state (FIG. 4*a*), of intermediate states (FIGS. 4*b* and 4*c*), and of the second, completely inflated operating state (FIG. 4*d*).

When in its folded state, the safety element 11 has joint nodes 23, which rest on the lower edge of the recess 9, i.e., the edge located at the bottom in the vertical plane (FIG. 3). When the pressurized fluid is activated (FIG. 4*a*), e.g., by means of electronic or electrical actuation of the pressurized fluid system 21 or by the explosive opening of a safety valve in the pressurized fluid system 21 or at the end of a supply line near the safety element 11, the incoming fluid first presses the folded-in areas of the safety element 11 down around the joint nodes 23 (FIG. 4*b*) and then outward (FIG. 4*c*), until the safety element 11 is completely full and taut (FIG. 4*d*).

The overall unsinkable security function of the invention can also be combined with a control unit (not shown), which, upon initiation of the second operating state of the safety element 13, automatically generates and transmits an emergency signal. The known GPS satellite navigation system, for example, is suitable for determining the location of the ship.

When the second operating state is activated, the control unit can also cause a sea anchor to be deployed. The sea anchor serves to stabilize the ship in the event that it can no longer be maneuvered, so that the bow of the ship will always be facing into the wind and into the waves.

The safety element does not necessarily have to be filled with compressed air or some other gas. It could also be filled with a sprayable foam, for example, which develops a stable foam structure inside the safety element 11.

What is claimed is:

1. A watercraft, comprising:

a solid hull having a solid outer side and a water line, said solid outer side defining an outer surface extending at least from the water line to a top of said outer side and a concave recess in said outer surface extending substantially horizontally above the water line, and at least one undercut projection having a shape formed in said concave recess;

an elastically deformable safety element having at least one concavity designed as a negative of the shape of said of least one projection such that said at least one projection engages said at least one concavity for connection of said safety element to said concave recess; and a source of pressurized fluid connected to said safety element and activatable for inflating said safety element with pressurized fluid for deploying the safety element from a first operating state, in which the safety element is folded onto itself, to a second operating state, in which the safety elements in inflated with the pressurized fluid for providing buoyancy and stability to said watercraft.

2. A watercraft according to claim 1, wherein said at least one concavity slides approximately horizontally onto said at least one projection for producing the engaged connection between said safety element and said concave recess.

3. A watercraft according to claim 1, wherein said at least one projection comprises at least two projections which are undercut to form a T-shaped recess therebetween.

4. A watercraft according to claim 1, wherein said at least one projection comprises a plurality of projections arranged adjacent to one another in the vertical direction.

5. A watercraft according to claim 1, wherein said at least one projection comprises a plurality of projections arranged in a horizontal row.

6. A watercraft according to claim 1, wherein said at least one projection comprises a plurality of projections offset from each other in the horizontal and vertical directions.

7. A watercraft according to claim 1, wherein said outer side of said hull comprises a stem and longitudinal sides, said concave recess being formed in said stem and longitudinal sides.

8. A watercraft according to claim 1, wherein said safety element is a hose-shaped body.

9. A watercraft according to claim 1, wherein said safety element forms a bumper strip for said hull in the first operating state of the safety element.

* * * * *